US009907340B2

(12) United States Patent
Liu

(10) Patent No.: US 9,907,340 B2
(45) Date of Patent: Mar. 6, 2018

(54) ELECTRONIC CIGARETTE AND METHOD FOR ASSEMBLING SAME

(71) Applicant: KIMREE HI-TECH INC., Road Town, Tortola (VG)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 15/120,322

(22) PCT Filed: Feb. 19, 2014

(86) PCT No.: PCT/CN2014/072276
§ 371 (c)(1),
(2) Date: Aug. 19, 2016

(87) PCT Pub. No.: WO2015/123832
PCT Pub. Date: Aug. 27, 2015

(65) Prior Publication Data

US 2017/0055586 A1 Mar. 2, 2017

(51) Int. Cl.
*A24F 47/00* (2006.01)
*B65D 39/00* (2006.01)
(Continued)

(52) U.S. Cl.
CPC ..... *A24F 47/008* (2013.01); *B65D 39/0005* (2013.01); *B65D 51/20* (2013.01);
(Continued)

(58) Field of Classification Search
CPC ..... A24F 47/008
See application file for complete search history.

(56) References Cited

U.S. PATENT DOCUMENTS

2008/0230052 A1 9/2008 Denain et al.
2013/0025609 A1* 1/2013 Liu ..... A24F 47/008 131/329
2013/0168880 A1* 7/2013 Duke ..... A24F 47/008 261/78.2

FOREIGN PATENT DOCUMENTS

CN 202005248 U 10/2011
CN 103237469 A 8/2013
(Continued)

OTHER PUBLICATIONS

International Search Report (ISR) issued by the State Intellectual Property Office of the Peoples Republic of China dated Sep. 26, 2014 for PCT/CN2014/072276, China.

*Primary Examiner* — Ross Gushi
(74) *Attorney, Agent, or Firm* — Tim Tingkang Xia, Esq.; Locke Lord LLP

(57) ABSTRACT

An electronic cigarette and method for assembling same is provided, wherein the electronic cigarette comprises an electronic cigarette body including a smoking end, an oil reservoir configured for reserving tobacco tar, an atomizer assembly configured for atomizing the tobacco tar, and a battery assembly electrically connected to the atomizer assembly and configured for supplying power to the atomizer assembly; the battery assembly and the oil reservoir are arranged in parallel; the atomizer assembly includes a heating wire assembly which is arranged at one end of the oil reservoir and is deposited outside the oil reservoir; a smoking channel is provided inside the electronic cigarette body, wherein the smoking channel is arranged outside the oil reservoir and is configured for discharging the smoke atomized by the atomizer assembly to the outside of the electronic cigarette body. The electronic cigarette can prevent the oil from penetrating into the smoking channel.

19 Claims, 10 Drawing Sheets

(51) Int. Cl.

| | |
|---|---|
| ***B65D 51/20*** | (2006.01) |
| ***H05B 1/02*** | (2006.01) |
| ***H05B 3/04*** | (2006.01) |
| ***H05B 3/44*** | (2006.01) |

(52) U.S. Cl.
CPC ..... *H05B 1/0244* (2013.01); *H05B 3/04* (2013.01); *H05B 3/44* (2013.01); *B65D 2251/009* (2013.01); *B65D 2251/0012* (2013.01); *B65D 2251/0028* (2013.01); *B65D 2251/0093* (2013.01); *H05B 2203/014* (2013.01); *H05B 2203/021* (2013.01); *H05B 2203/022* (2013.01)

(56) References Cited

FOREIGN PATENT DOCUMENTS

| | | | |
|---|---|---|---|
| CN | 203314099 | U | 12/2013 |
| CN | 203327954 | U | 12/2013 |
| CN | 203353680 | U | 12/2013 |

* cited by examiner

ELECTRONIC CIGARETTE AND METHOD FOR ASSEMBLING SAME

TECHNICAL FIELD

The present application relates to the technical field of electric heating products, and more particularly, relates to an electronic cigarette and an assembly method for an electronic cigarette.

BACKGROUND

For an electronic cigarette in the prior art, an oil reservoir is generally mounted in an atomizer assembly that is arranged coaxially with a battery assembly. The oil reservoir and the battery assembly are in serial connection to each other from up to down. In this way, a cigarette body of the electronic cigarette is too long, and thus the electronic cigarette is inconvenient to carry. The whole appearance and the touch feeling of the electronic cigarette are therefore impacted. Besides, when the electronic cigarette in the prior art suffers a collision, a junction between the atomizer assembly and the battery assembly may be broken down easily, and thus the electronic cigarette is inconvenient to use. Furthermore, a smoke channel configured for the smoke to flow passes through the oil reservoir, and tobacco tar may be therefore leaked into the smoke channel. In this way, oil leaking may be occurred, smoke may be condensed when the tobacco tar is heated, and the tobacco tar may be sucked in during smoking.

BRIEF SUMMARY

The objective of the present application is to provide an electronic cigarette which is convenient to carry, preventing the tobacco tar from leaking into the smoke channel, preventing the smoke from condensing when the tobacco tar is heated, and further preventing the tobacco tar from being sucked into the mouth by a user.

In accordance with one aspect of the present application, an electronic cigarette is provided, which comprises an electronic cigarette body and an oil reservoir configured for reserving tobacco tar. The electronic cigarette body includes a smoking end, and a battery assembly electrically connected to the atomizer assembly and configured for supplying power to the atomizer assembly. The battery assembly and the oil reservoir are arranged in parallel. The atomizer assembly includes a heating wire assembly which is arranged outside one end of the oil reservoir, wherein the end is adjacent to the oil reservoir.

A smoking channel is provided inside the electronic cigarette body, wherein the smoking channel is arranged outside the oil reservoir and is configured for discharging the smoke atomized by the atomizer assembly to the outside of the electronic cigarette body.

In one embodiment, the oil reservoir is transparent and is arranged outside the electronic cigarette body.

In one embodiment, the oil reservoir is detachably arranged on the electronic cigarette body.

In one embodiment, the electronic cigarette body further includes a bracket, the atomizer assembly and the oil reservoir are respectively detachably connected to the bracket; one end of the atomizer assembly is contained in the bracket, and the other end of the atomizer assembly extends into the oil reservoir.

In this embodiment, the battery assembly is contained in the bracket.

In this embodiment, a mouth of the oil reservoir is sealed with an annular sealing plug having a through-hole;

a piercable thin film configured for sealing the oil reservoir is arranged inside the through-hole of the annular sealing plug.

In this embodiment, the atomizer assembly further includes an oil guiding mechanism configured for conveying tobacco tar inside the oil reservoir to the heating wire assembly for the atomization of the tobacco tar.

Wherein one end of the oil guiding mechanism passes through the through-hole and is further inserted in the oil reservoir; the oil guiding mechanism and the through-hole is sealed with the annular sealing plug.

In this embodiment, one end of the oil guiding mechanism that is outside the oil reservoir is hollow, in which way that an atomizer cavity is formed, and the heating wire assembly is contained in the atomizer cavity.

In one embodiment, the smoking end is positioned at one end of the bracket, and the end is away from the oil reservoir, and an air outlet is formed on the smoking end; an air inlet is defined in the bracket, and the atomizer cavity is communicated with the air inlet and the air outlet respectively, in which way that the smoking channel is formed.

In this embodiment, a first electrode array is arranged at one end of the atomizer assembly, the end is close to the smoking end, and the first electrode array is electrically connected to the atomizer assembly and the battery assembly respectively; wherein the first electrode array is hollow, and is communicated with the atomizer cavity and the air outlet respectively.

In this embodiment, the battery assembly is detachably arranged inside the bracket; a second electrode array is arranged at one end of the battery assembly, the end is close to the smoking end, and the second electrode array is electrically connected to the battery assembly; the first electrode array and the second electrode array are electrically connected to each other.

In this embodiment, the battery assembly is fixedly arranged inside the bracket; a third electrode array electrically connected to the first electrode array is arranged on the bracket; wherein the atomizer assembly is electrically connected to the battery assembly via the first electrode array, the third electrode array and wires connected to the third electrode array.

In this embodiment, a charging assembly configured for supplying power to the battery assembly is provided on the bracket.

In another embodiment, a blocking portion configured for preventing the tobacco tar condensed from being sucked in is extending from an edge of the air outlet in a direction opposite to a flowing direction of the airflow.

In this embodiment, the smoking end includes a connection portion which is detachably mounted on the bracket.

In this embodiment, the smoking end includes a smoking portion in shape of a frustum with its diameter reduced from the connection portion along a direction away from the bracket by a constant-gradient method.

In a further embodiment, the smoking end includes a smoking portion that is projected from the connection portion in a direction away from the bracket and bent towards one side.

In a further embodiment, the electronic cigarette further includes a button which is arranged on the smoking end or the bracket and is configured to receive operation instructions of a user.

The control assembly is further connected to the button and is configured to generate a control signal based on the operation instructions of a user. Wherein, the control assembly is connected to the heating wire assembly, in which way that the heating wire assembly atomizer the tobacco tar based on the control signal.

In accordance with another aspect of the present application, an electronic cigarette is further provided, which comprises an electronic cigarette body and an oil reservoir configured for reserving tobacco tar, wherein the electronic cigarette body includes a smoking end, an atomizer assembly configured for atomizing the tobacco tar, and a battery assembly electrically connected to the atomizer assembly and configured for supplying power to the atomizer assembly. Wherein the battery assembly and the oil reservoir are arranged in parallel; the atomizer assembly includes a heating wire assembly which is arranged outside one end of the oil reservoir, wherein the end is adjacent to the oil reservoir. A smoking channel is provided inside the electronic cigarette body, wherein the smoking channel is arranged outside the oil reservoir and is configured for discharging the smoke atomized by the atomizer assembly to the outside of the electronic cigarette body. The oil reservoir is transparent and is arranged outside the electronic cigarette body.

The atomizer assembly further includes an oil guiding mechanism configured for conveying tobacco tar inside the oil reservoir to the heating wire assembly for the atomization of the tobacco tar.

A mouth of the oil reservoir is sealed with an annular sealing plug having a through-hole.

One end of the oil guiding mechanism passes through the through-hole and is further inserted in the oil reservoir; one end of the oil guiding mechanism is hollow in which way that an atomizer cavity is formed, wherein the end is outside the oil reservoir, and the heating wire assembly is contained in the atomizer cavity. The smoking end is positioned at one end of the bracket, wherein the end is away from the oil reservoir, and an air outlet is formed on the smoking end; an air inlet is defined in the bracket, and the atomizer cavity is communicated with the air inlet and the air outlet respectively, in which way that the smoking channel is formed.

In accordance with another aspect of the present application, an assembly method for an electronic cigarette, wherein the assembly method is configured for assembling an electronic cigarette, and comprising the following steps:

S1, providing a bracket having a first electrode array and a second electrode array, and electrically connecting the first electrode array to the second electrode array; providing an oil reservoir in which an atomizer assembly is partially inserted; defining a through-hole configured to hold the atomizer assembly inserted in the oil reservoir, and arranging an annular sealing plug sealed with a thin film on the through-hole; electrically connecting the first electrode array to a second electrode array through a bouncing pin electrode;

S2, one end of an oil guiding mechanism of the atomizer assembly piercing the thin film and further inserting into the oil reservoir; sealing the through-hole and the oil guiding mechanism with the annular sealing plug; fixedly connecting the other end of the oil guiding mechanism to the first electrode array;

S3, forming an atomizer cavity at one end of the oil guiding mechanism, the end being away from the oil reservoir, and arranging a heating wire assembly in the atomizer cavity; electrically connecting the heating wire assembly to the battery assembly;

S4, containing the battery assembly in the bracket, and arranging the atomizer assembly and the battery assembly in parallel; electrically connecting the battery assembly to a second electrode array; arranging the smoking end at one end of the bracket, the end being away from the oil reservoir.

When implementing the electronic cigarette and the assembly method for the electronic cigarette of the present application, the following advantageous can be achieved: by arranging the oil reservoir and the atomizer assembly in parallel, the total length of the electronic cigarette is reduced, and thus the electronic cigarette is convenient to carry. Besides, the structure of the electronic cigarette is ingenious, and has a high mechanical strength. Besides, the diameter of the electronic cigarette is larger, and the sucking and holding of the electronic cigarette is full of fun, thereby meeting the psychological requirements of a smoker who often smokes a cigarette with a large diameter, such as a cigar. Furthermore, since the smoking channel is arranged outside the oil reservoir, in this way, the tobacco tar may be prevented from leaking into the smoking channel, and the problems that oil is leaking and the tobacco tar is sucked into the mouth may be solved as a result.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

In order to overcome the drawbacks in the prior art that the cigarette body of the electronic cigarette is too long, the electronic cigarette is inconvenient to carry, and the oil reservoir is hard to change due to the serial connection between the oil reservoir and the battery assembly, an electronic cigarette is provided, wherein a battery assembly 4 and an oil reservoir 2 are arranged in parallel, a smoking channel is deposited outside the oil reservoir 2. In this way, the tobacco tar is avoided from being sucked into the mouth, and the smoke is avoided from condensing when the tobacco tar is heated during smoking.

In order to make the technical features, the propose and the technical effect of the present application more clearly, the present application will now be described in detail with reference to the accompanying drawings and embodiments.

Figure 1:
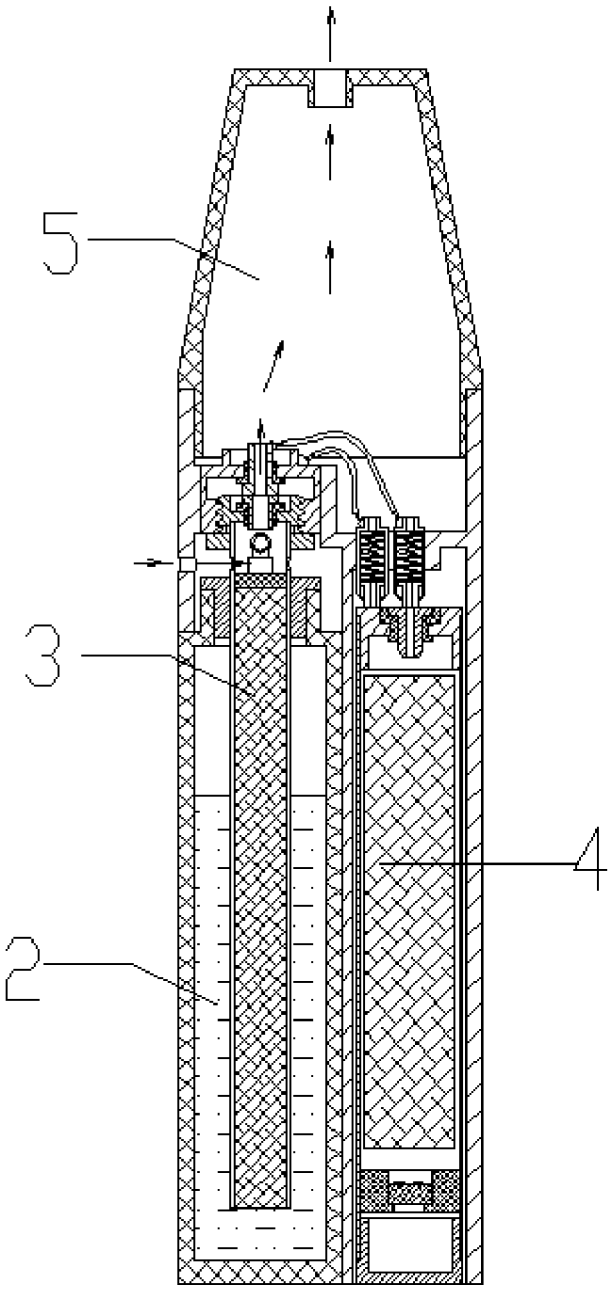
FIG. 1 illustrates a cutaway view of an electronic cigarette according to a first embodiment of the present application.

As shown in FIG. 1, an electronic cigarette is provided, which comprises an electronic cigarette body and an oil reservoir 2 configured for reserving tobacco tar. The electronic cigarette body includes a smoking end, an atomizer assembly 3 configured for atomizing the tobacco tar, and a battery assembly 4 electrically connected to the atomizer assembly 3 and configured for supplying power to the atomizer assembly 3. The battery assembly 4 and the oil reservoir 2 are arranged in parallel. The atomizer assembly 3 includes a heating wire assembly 31 which is arranged outside one end of the oil reservoir 2, wherein the end is adjacent to the oil reservoir 2. A smoking channel is formed inside the electronic cigarette body, which is arranged outside the oil reservoir 2 and is configured for discharging the smoke atomized by the atomizer assembly 3 to the outside of the electronic cigarette body.

In this case, the arrow shown in FIG. 1 directs to a course formed, that is, the course of the airflow and the smoking channel.

It may be understood that, the smoking channel will not pass through the oil reservoir 2. In this way, the tobacco tar is prevented from leaking into the smoking channel, and the problems that oil is leaking and the tobacco tar is sucked into the mouth may be solved as a result.

Meanwhile, the arrangement of the battery assembly 4 and the oil reservoir 2 in parallel results in an ingenious structure design, so that the electronic cigarette is short, is convenient to carry, and has a high mechanical strength. In this way, a diameter of the electronic cigarette is larger, and the sucking and holding of the electronic cigarette is full of fun, thereby meeting psychological requirements of a smoker who often smokes a cigarette with a large diameter, such as a cigar. Besides, the electronic cigarette is hard to be broken even with the application of an external force.

Likewise, as shown in FIG. 1, the oil reservoir 2 is arranged outside the electronic cigarette body, and is detachably connected to the electronic cigarette body. By depositing the oil reservoir 2 outside the electronic cigarette body, the tobacco tar is convenient to observe, and may be added into the oil reservoir 2 in time as a result. Meanwhile, the oil reservoir 2 is detachably connected to the electronic cigarette body, and thus it is convenient for the user to add the tobacco tar or change a tobacco tar bottle with a different taste.

Preferably, the oil reservoir 2 is transparent, and is convenient for observing the tobacco tar inside the oil reservoir 2.

The electronic cigarette body further includes a bracket 1, and the atomizer assembly and the oil reservoir 2 are respectively detachably connected to the bracket 1. At this time, the batter assembly is contained in the bracket 1.

Furthermore, since the atomizer assembly 3 is prone to wear, the atomizer assembly 3 is needed to be changed. When the atomizer assembly 3 is detachably connected to the bracket 1, the atomizer assembly 3 is convenient to be changed for the user.

Figure 2:
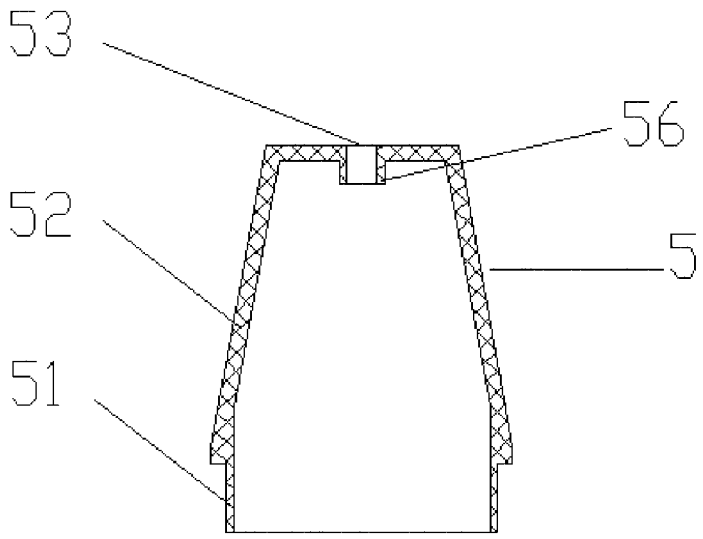
FIG. 2 illustrates a cutaway view of a smoking end shown in FIG. 1.

As shown in FIG. 2, a smoking end 5 is positioned at one end of the bracket 1, wherein the end is away from the oil reservoir 2, and an air outlet 53 is formed on the smoking end 5. A blocking portion 56 configured for preventing the tobacco tar condensed from being sucked in is extending from an edge of the air outlet 53 in a direction opposite to a flowing direction of the airflow. It may be understood that, the tobacco tar atomized may be condensed in a marginal area of the blocking portion 56 during smoking. With the blocking of the blocking portion 56, the liquid tobacco tar condensed is hard to be sucked into the mouth of the smoker from the air outlet 53. Specifically, the blocking portion 56 is in shape of a cylinder, and an extending length of the blocking portion 56 is 10 mm~30 mm. Preferably, the extending length of the blocking portion 56 is 20 mm.

Figure 3:
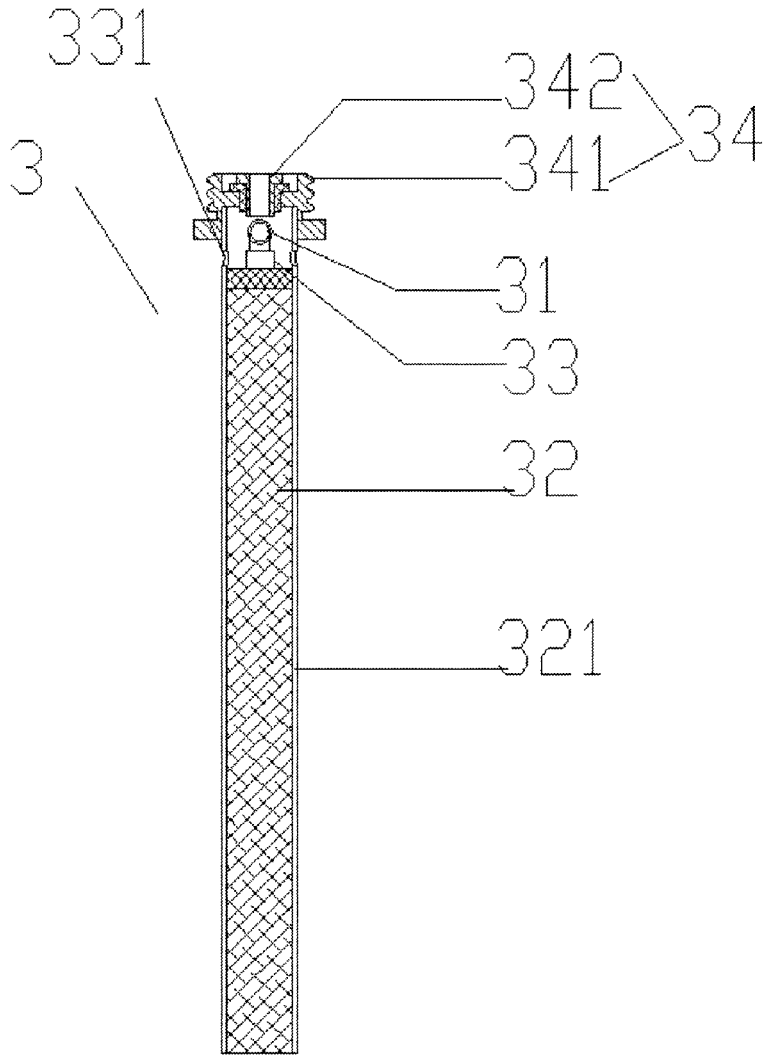
FIG. 3 illustrates a cutaway view of an atomizer assembly shown in FIG. 1.

As shown in FIG. 1, and combing with FIG. 3, for the electronic cigarette according to the first embodiment, the atomizer assembly 3 includes the heating wire assembly 31 configured for atomizing tobacco tar, and an oil guiding mechanism 32 configured for conveying the tobacco tar inside the oil reservoir 2 to the heating wire assembly 31 for the atomization thereof.

Figure 4:
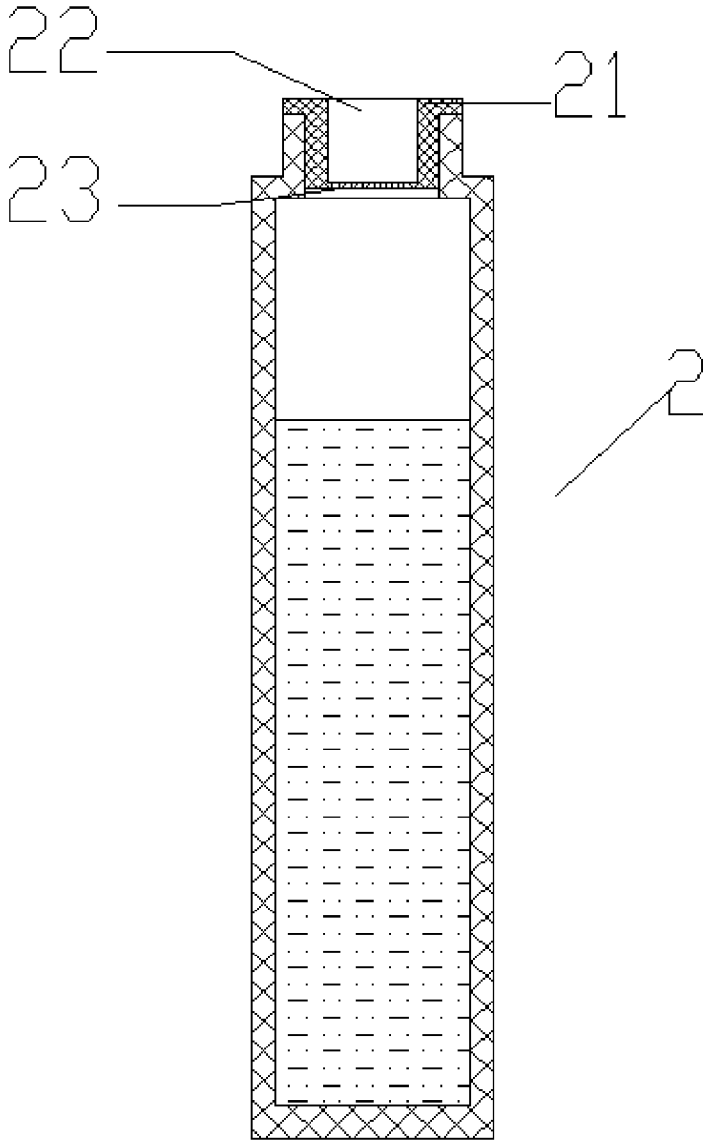
FIG. 4 illustrates a cutaway view of an oil reservoir shown in FIG. 1.

Referring to FIG. 4, a mouth of the oil reservoir 2 is sealed with an annular sealing plug 21 having a through-hole 22.

A piercable thin film 23 configured for sealing the oil reservoir 2 is arranged inside the through-hole 22 of the annular sealing plug 21.

One end of the oil guiding mechanism 32 passes through the through-hole 22 and is further inserted in the oil reservoir 2. The oil guiding mechanism 32 and the through-hole 22 is sealed with the annular sealing plug 21.

One end of the oil guiding mechanism 32 is hollow, in which case the end is outside the oil reservoir 2; and thus an atomizer cavity 33 is formed, and the heating wire assembly 31 is contained in the oil guiding mechanism 32.

Figure 5:
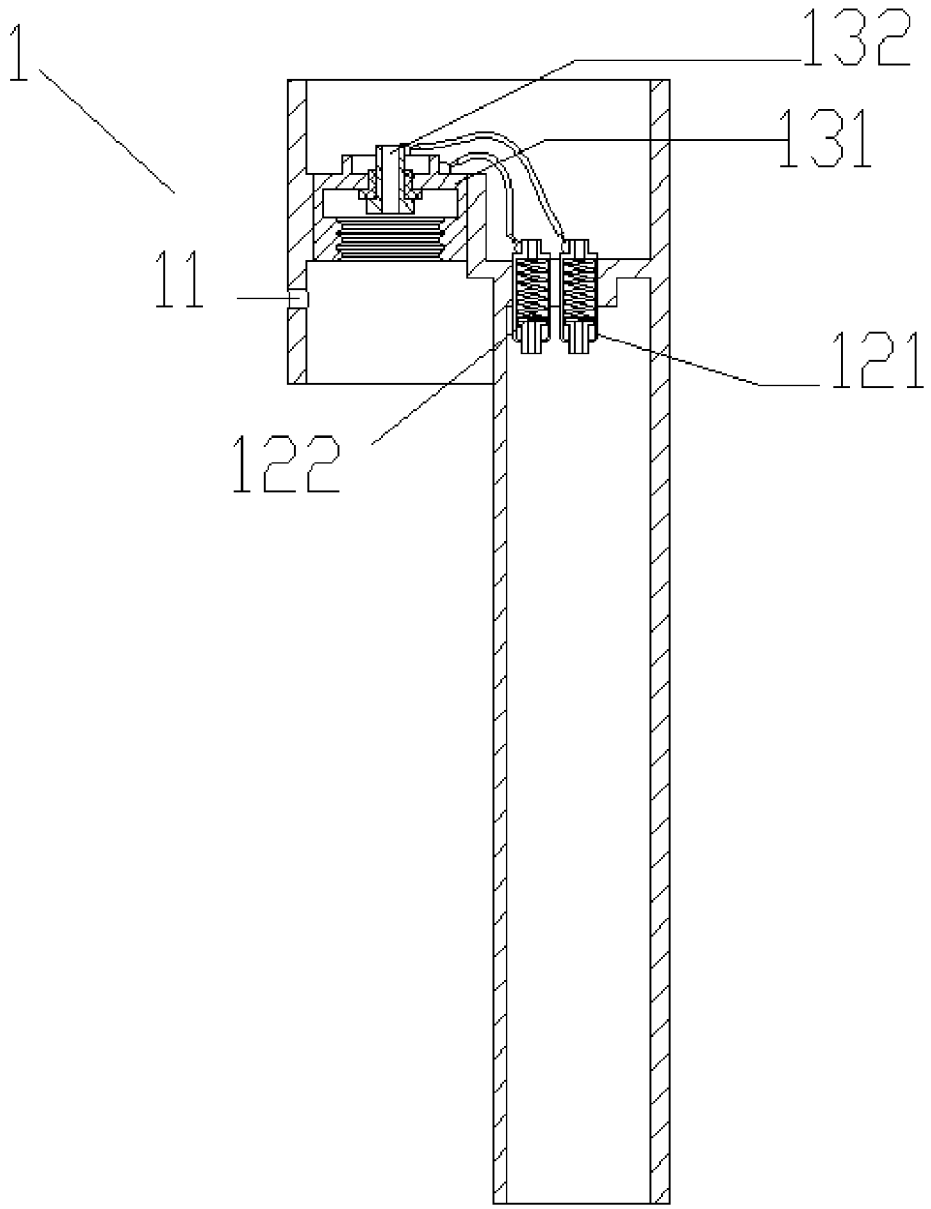
FIG. 5 illustrates a cutaway view of a bracket shown in FIG. 1.

Referring to FIG. 5, an air inlet 11 is defined in the bracket 1, and the atomizer cavity 33 is communicated with the air inlet 11 and the air outlet 53 respectively, and the smoking channel is therefore formed. It may be understood that, a vent hole 331 is defined on an inner wall of the atomizer cavity 33. The air inlet is arranged in the position of the bracket 1 that is corresponding to the vent hole 331, and is communicated with the vent hole 331. The air inlet 11 and the air outlet 53 have an area of 2 $mm^2$~7 $mm^2$. Preferably, the air inlet 11 and the air outlet 53 have an area of 3 $mm^2$.

Specifically, as shown in FIG. 3, the oil guiding mechanism 32 includes a sleeve tube 321 with both ends thereof communicated with each other. One end of the sleeve tube 321 is inserted in the oil reservoir 2, and has an oil guiding cotton arranged therein. The other end of the sleeve tube 321 is hollow, in this case the other end extends outside the oil reservoir 2; and thus the atomizer cavity 33 aforesaid is formed. The liquid tobacco tar inside the oil reservoir 2 may enter the oil guiding cotton through an opening at the end of the sleeve tube 321, and the end is inserted inside the oil reservoir 2. The tobacco tar is further supplied to the atomizer assembly 3. The vent hole 331 is defined in the sleeve tube 321 in this case, and thus the communication between the air inlet and the atomizer cavity 33 may be achieved.

The heating wire assembly 31 includes an oil guiding string, and a heating wire twined around the oil guiding string. The oil guiding string is further extending into the oil guiding cotton, and thus the tobacco tar is provided to the oil guiding string via the oil guiding cotton.

The sleeve tube 321 is made of hard materials, and is inserted into the annular sealing plug 21 by an interference fit. It may be understood that, the annular sealing plug 21 is not only sealing the oil reservoir 2 and preventing the tobacco tar from leaking out of the oil reservoir 2, but also tightly fixing the sleeve tube 321 thereon since the annular sealing plug 21 is tightly fitted to the hard sleeve tube 321. In addition, the oil reservoir 2 may be detachably connected to the atomizer assembly 3 with the assembly and disassembly of the oil guiding mechanism 32 and the annular sealing plug 21. Preferably, the annular sealing plug 21 is made from silicon.

Furthermore, a first electrode array 34 is arranged at one end of the atomizer assembly 3, the end is close to the smoking end 5, and the first electrode array 34 is electrically connected to the atomizer assembly 3 and the battery assembly 4 respectively. The first electrode array 34 is hollow, and is communicated with the atomizer cavity 33 and the air outlet 53 respectively. At this time, the airflow may flow into the electronic cigarette through the air inlet 11, pass through the atomizer cavity 33 and the hollow first electrode array 34, and finally flow out through the air outlet 53 (specifically, the direction of the arrow in FIG. 1 is the flow direction of the air).

Specifically, the first electrode array 34 includes a first external electrode 341 and a first inner electrode 342 that is insulated from the first external electrode 341 and deposited on the inner side of the first external electrode 341. The heating wire assembly 31 includes a first terminal and a second terminal, wherein the first external electrode 341 is connected to the first terminal of the heating wire assembly 31, and the first inner electrode 342 is connected to the second terminal of the heating wire assembly 31. One end of the sleeve tube 321 is inserted into the first external electrode 341 by an interference fit, and the end is close to the smoking end 5.

As shown in FIG. 1 and FIG. 5, a third electrode array is also provided on the bracket 1, wherein the third electrode array includes a third external electrode 131 and a third inner electrode 132 that is insulated from the third external electrode 131 and deposited on the inner side of the third external electrode 131. Wherein, the first external electrode 341 is connected to the third external electrode 131, and the first inner electrode 342 is connected to the third inner electrode 132. Since the first pair of electrodes and the second pair of electrodes are metal pieces, the electrical connection between the first inner electrode 342 and the third inner electrode 132 may be achieved by abutting the first inner electrode 342 against the third inner electrode 132. While the electrical connection between the first external electrode 341 and the third external electrode 131 may be achieved by abutting the first external electrode 341 against the third external electrode 131, or by screwing the first external electrode 341 onto the third external electrode 131. The first external electrode 341 and the third external electrode 131 may be connected to each other by a thread connection, in such a way that the first external electrode 341 and the third external electrode 131 may be conveniently detached from each other. In this case, the first electrode array 34 forms a part of the atomizer assembly 3, and the third external electrode 131 is fixed on the bracket 1. The first external electrode 341 is detachably connected to the third external electrode 131, and thus, the atomizer assembly is detachably connected to the bracket 1.

It may be understood that, an insulator may be arranged between the first external electrode 341 and the first inner electrode 342, and between the third external electrode 131 and the third inner electrode 132.

The battery assembly 4 is detachably arranged inside the bracket 1. A second electrode array 41 is arranged at one end of the battery assembly 4, the end is close to the smoking end 5, and the second electrode array 41 is electrically connected to the battery assembly. The first electrode array 34 and the second electrode array 41 are electrically connected to each other for the convenience of detaching.

Figure 6:
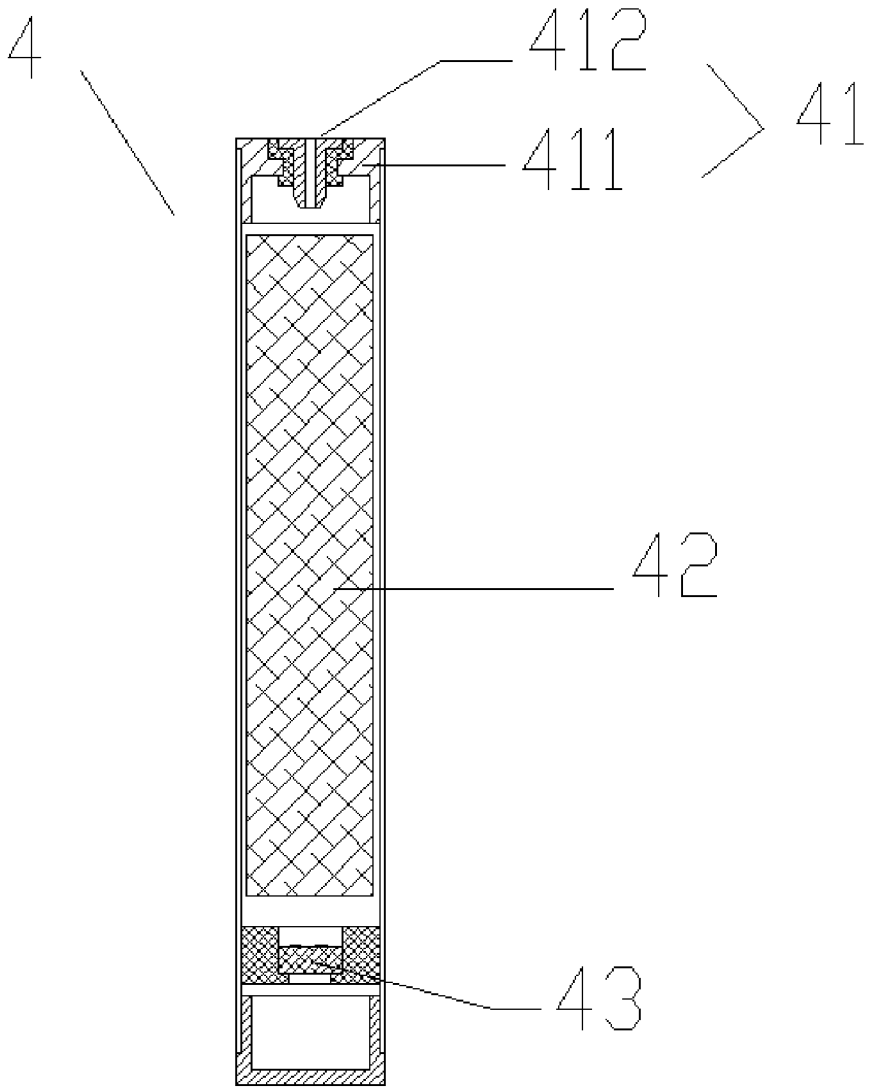
FIG. 6 illustrates a cutaway view of a battery assembly shown in FIG. 1.

Specifically, as shown in FIGS. 1, 5 and 6, the battery assembly 4 further includes a battery 42 configured for supplying power to the electronic cigarette, wherein the battery includes a first battery electrode and a second battery electrode. The second electrode array 41 includes a second external electrode 411 and a second inner electrode 412 that is insulated from the second external electrode 411 and deposited on the inner side of the second external electrode 412. Wherein, the first battery electrode is connected to the second external electrode 411, and the second battery electrode is connected to the second inner electrode 412.

Specifically, a bouncing pin electrode is provided between those electrodes for the connections thereof. In this case, the bouncing pin electrode includes a first bouncing pin electrode 121 and a second bouncing pin electrode 122. The first bouncing pin electrode 121 includes a first bouncing pin, and the second bouncing pin electrode includes a second bouncing pin. One end of the first bouncing pin electrode 121 is connected to the third external electrode 131, and the other end of the first bouncing pin electrode 121 is abutted against the second external electrode 411 through the first bouncing pin. While one end of the second bouncing pin electrode 122 is connected to the third inner electrode 132, and the other end of the second bouncing pin electrode 122 is abutted against the second inner electrode 412 through the second bouncing pin. It may be understood that, each bouncing pin of the bouncing pin electrodes is stretchable with the application of external force. When the bouncing pin is abutted against the corresponding battery electrode, the bouncing pin electrode may be electrically connected to the battery electrode, and is convenient for detaching, and the connection between the battery electrodes is stable.

Preferably, the bouncing pin electrode is fixed on the bracket 1, and the battery assembly is inserted in the bracket 1 by an interference fit.

The electronic cigarette further includes a control module 43 configured to control the working states of the electronic cigarette. At this time, the control module 43 is preferably arranged inside the battery assembly 4 at one end of the battery assembly 4, the end is away from the second electrode array 41.

It may be understood that, the second electrode array 41 is hollow and is communicated with the air outlet 53. Preferably, a vent hole is defined at one end of the battery assembly 4, and the end is close to the battery 42. The vent hole is configured to make an airflow sensor of the control module 43 to sense the pressure during suction, and further control the start and the end of the smoking through the control module 43.

Figure 7:
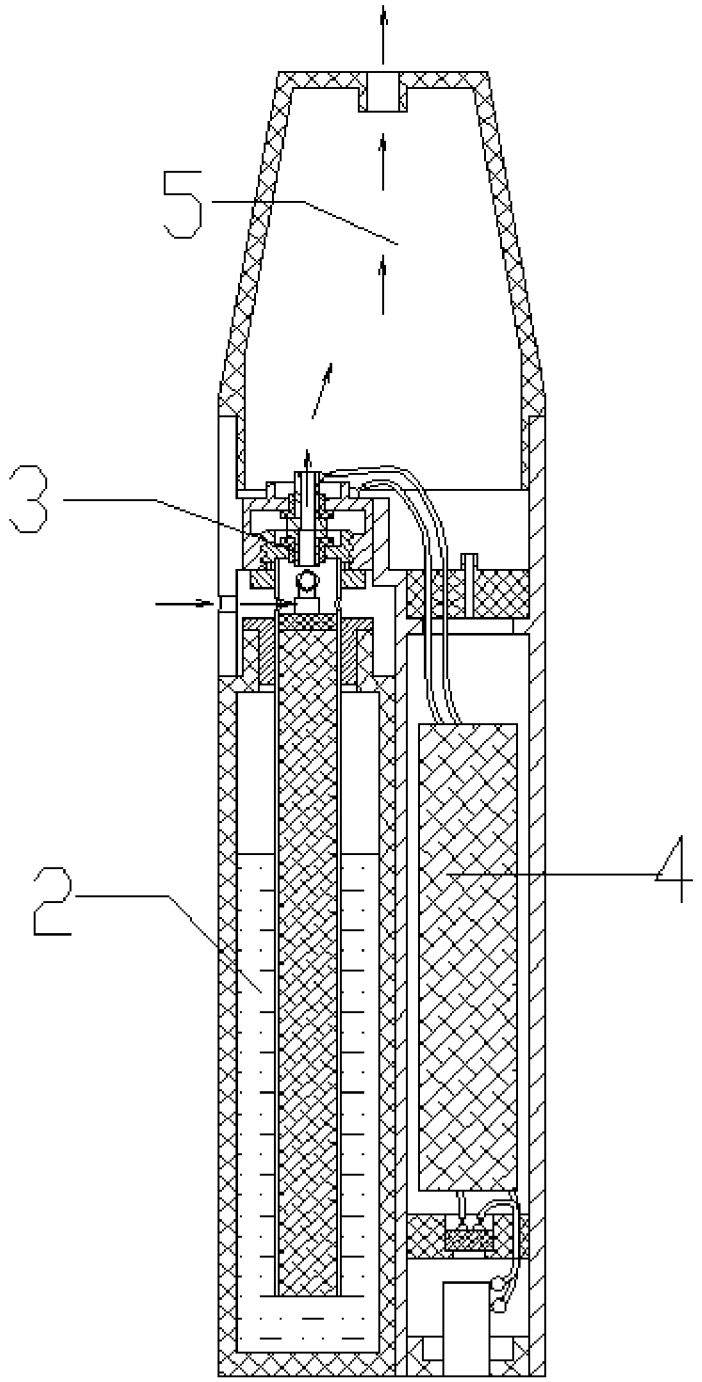
FIG. 7 illustrates a cutaway view of an electronic cigarette according to a second embodiment of the present application.

FIG. 7 shows a second embodiment of the electronic cigarette. In this case, different from the electronic cigarette in the first embodiment, the battery assembly 4 is fixed inside the bracket 1. The atomizer assembly 3 is electrically connected to the battery assembly 4 via the first electrode array 34, the third electrode array and wires connected to the third electrode array. In this case, although the battery assembly 4 is non-detachable, however, the battery assembly 4 is connected to the first electrode array 34 via the third electrode array and the wires. In this way, the structure is simple, and the assembly is convenient.

Figure 8:
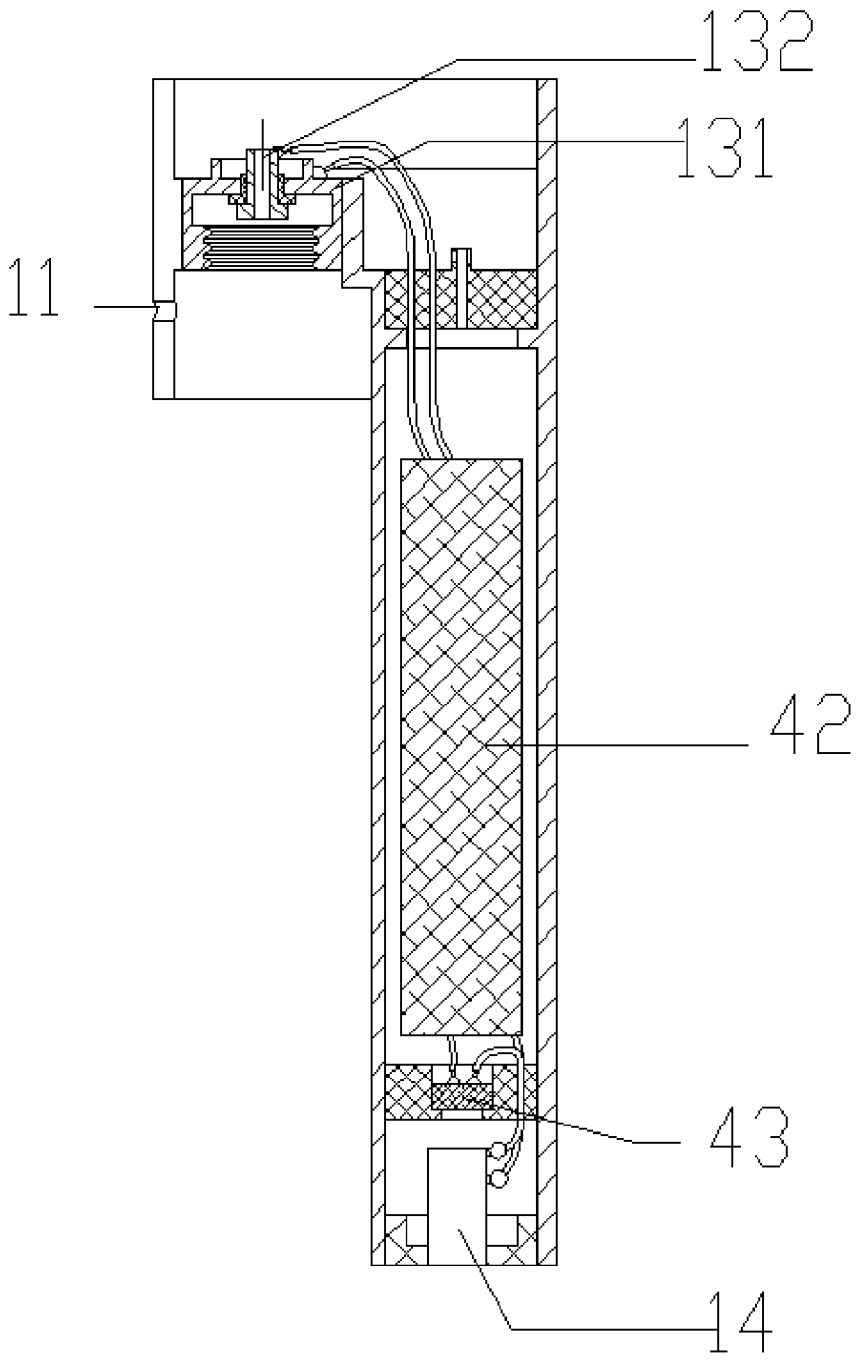
FIG. 8 illustrates a cutaway view showing an assembly of the bracket and the battery assembly shown in FIG. 1.

As shown in FIG. 8, as a charging assembly 14 electrically connected to the control module 43 and configured for charging the battery assembly 4 is correspondingly arranged at one end of the electronic cigarette body, and the end is close to the control module 43, the charging is convenient.

In the two embodiments above, the smoking end 5 includes a connection portion 51 which is detachably mounted on the bracket 1. In this way, the smoking end 5 is convenient to change and clean since the smoking end 5 is detachably connected to the bracket 1.

Likewise, in the two embodiments above, the smoking end 5 is in shape of a frustum with its diameter reduced from the connection portion 51 along the direction away from the oil reservoir 2 by a constant-gradient method. The air outlet 53 is arranged on an end face of the frustum, and the end face has a smaller area.

It may be understood that, for the beauty of the appearance, an external diameter of the connection portion 51 of the smoking end 5 is substantially equal to an inner diameter of one end of the bracket 1, and the end is away from the oil reservoir 2. The junction between smoking end 5 and the bracket 1 is smooth.

The bracket 1 further includes a blocking element that is configured to separate the battery of the battery assembly 4 from the atomizer cavity 33. In this way, the tobacco tar atomized may enter the smoking end 5 from the atomizer cavity 33 and further enter the battery assembly 4. Preferably, the blocking element is a baffle that is integrated with the bracket 1. It may be understood that, an opening communicated with the air outlet 53 is defined on the blocking element, and thus, the airflow sensor may sense the pressure of the airflow during suction.

Specifically, when the battery assembly is detachably arranged on the bracket 1, i.e., the first embodiment, the bouncing pin electrode is fixedly inserted in the blocking element. However, when the battery assembly 4 is fixedly arranged on the bracket 1, i.e., the second embodiment, the wires for connecting the battery assembly 4 to the first electrode array 34 extend through the blocking element.

Figure 9:
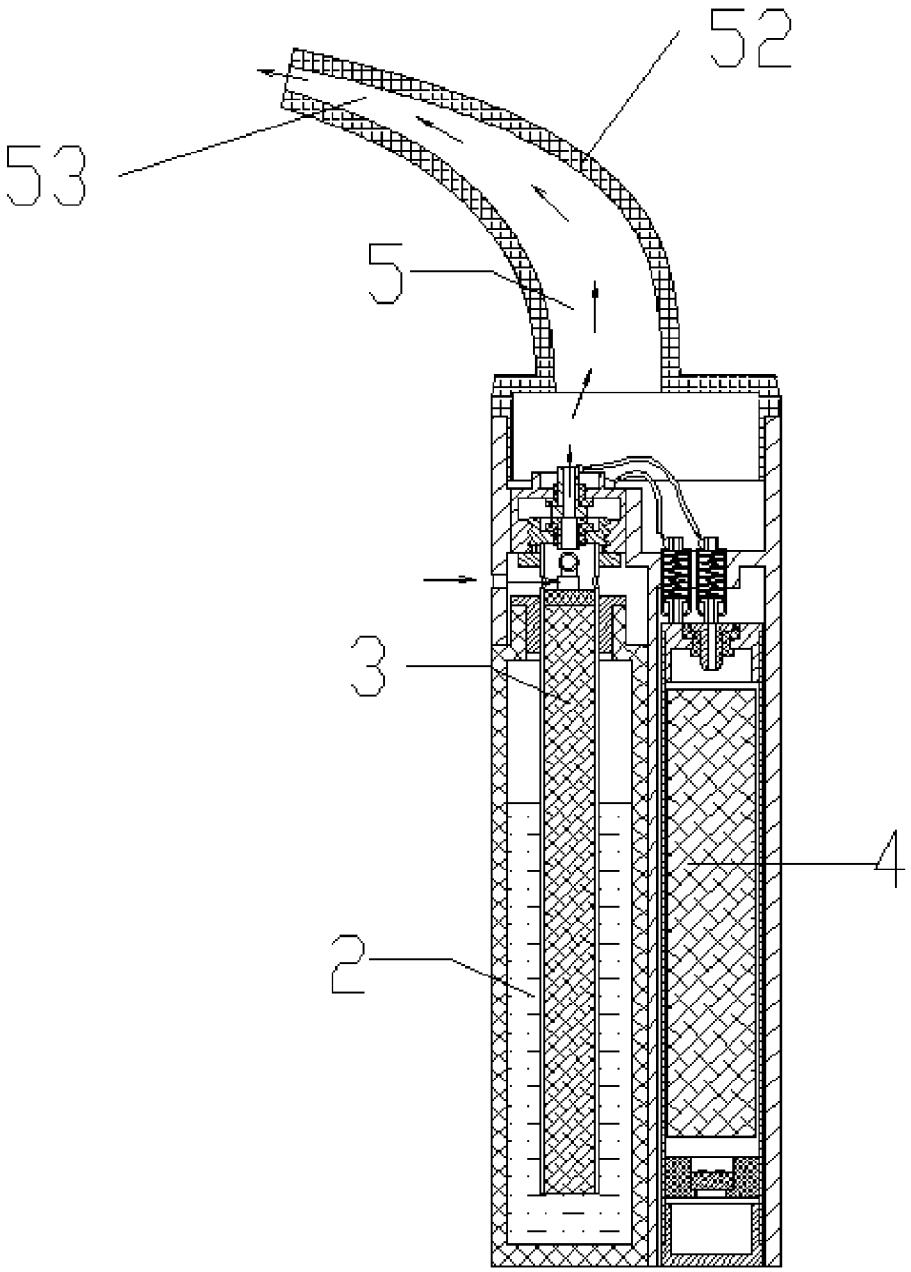
FIG. 9 illustrates a cutaway view of an electronic cigarette according to a third embodiment of the present application.

FIG. 9 shows a third embodiment of the electronic cigarette. In this case, different from the electronic cigarette in the first embodiment, for the convenience of smoking, the smoking end 5 includes a smoking portion 52 that is projecting from the connection portion 51 in a direction away from the bracket 1 and bending towards one side. A blocking element configured to separate the battery of the battery assembly 4 from the atomizer cavity 33 is also arranged in the bracket 1.

In this case, the diameter of the air outlet 53 is gradually reduced from one side of the air outlet 53 that is close to the connection portion along the flowing direction of the air flow. In this way, when the airflow enters the mouth of the smokers, the flowing speed is high, and the smoking taste is good.

In the third embodiment, the battery assembly is non-detachable, such as the battery assembly 4 in the second embodiment. Since the connections between the bracket 1, the atomizer assembly 3 and the battery assembly 4 are described in the first and the second embodiments above, they will not be described in detail any more.

Figure 10:
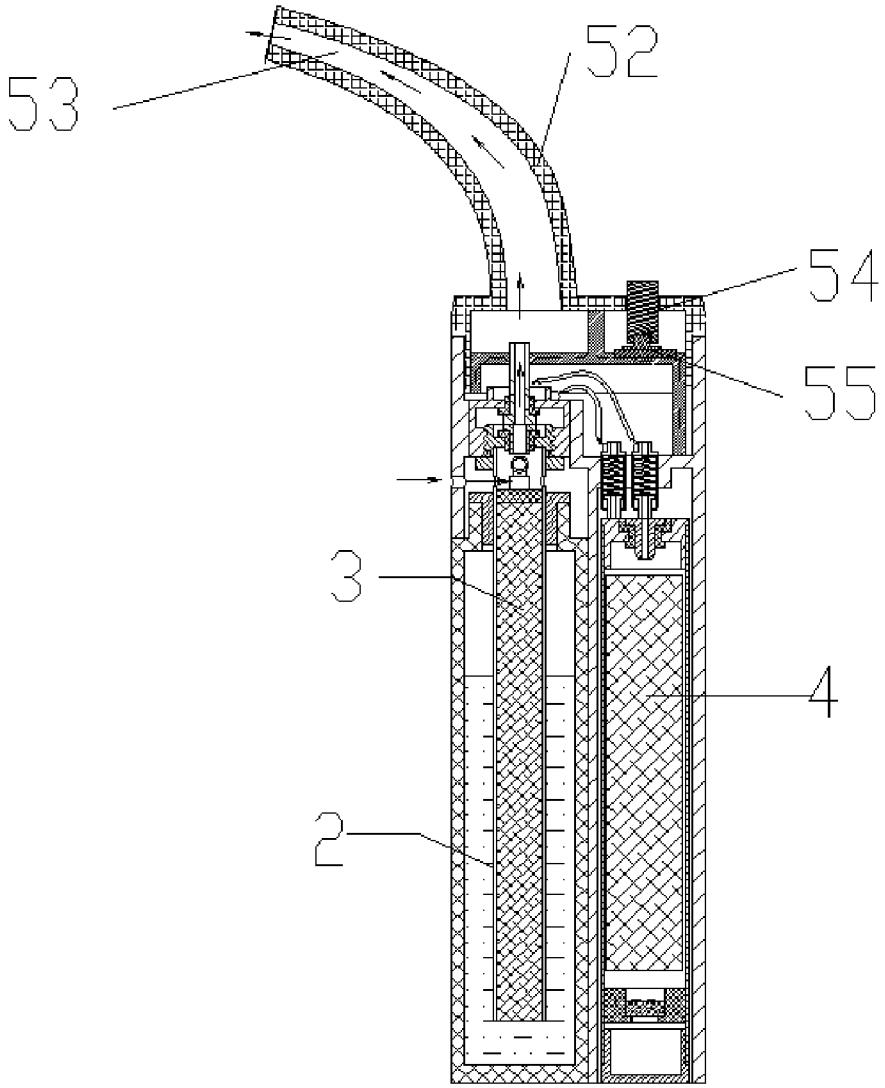
FIG. 10 illustrates a cutaway view of an electronic cigarette according to a fourth embodiment of the present application.

FIG. 10 shows a third embodiment of the electronic cigarette. In this case, different from the electronic cigarette in the third embodiment, the electronic cigarette further includes a button 54 which is arranged on the smoking end 5 or the bracket 1 and is configured to receive operation instructions of a user. A control assembly 55 is further connected to the button 54 and is configured to generate a control signal based on the operation instructions of a user. The control assembly 55 is connected to the heating wire assembly 31, so that the heating wire assembly 31 may atomizer the tobacco tar based on the control signal.

Since the electronic cigarette with oil reservoir 2 and the battery assembly 4 arranged in parallel has a large diameter, for the beauty of the appearance and the convenience of controlling, the control assembly 55 is arranged in the smoking end 5. One end of the button 54 extends through the smoking end 5 and finally positions outside the smoking end 5.

The present application further provides an assembly method for the electronic cigarette configured to assemble the electronic cigarette, comprising the following steps:

In steps S1, a bracket 1 having a first electrode array 34 and a second electrode array 41 is provided, and the first electrode array 34 is electrically connected to the second electrode array 41. Besides, an oil reservoir 2 is provided, in which an atomizer assembly 3 is partially inserted. A through-hole 22 configured to hold the atomizer assembly 3 inserted is defined in the oil reservoir 2, and an annular sealing plug 21 sealed with a thin film 23 is arranged on the through-hole 22. The first electrode array 34 is electrically connected to a second electrode array 41 through a bouncing pin electrode.

In step S2, one end of an oil guiding mechanism 32 of the atomizer assembly 3 pierces the thin film 23 and further inserts into the oil reservoir 2. The through-hole 22 and the oil guiding mechanism 22 are sealed with the annular sealing plug 21. Furthermore, the other end of the oil guiding mechanism 32 is fixedly connected to the first electrode array 34.

In step S3, an atomizer cavity 33 is formed at one end of the oil guiding mechanism 32, the end is away from the oil reservoir 2, and a heating wire assembly 31 is arranged in the atomizer cavity 33. The heating wire assembly 31 is electrically connected to the battery assembly 4.

In step S4, the battery assembly 4 is contained in the bracket 1, and the atomizer assembly 3 and the battery assembly 4 are arranged in parallel. The battery assembly is further electrically connected to a second electrode array 41. The smoking end 5 is arranged at one end of the bracket 1, and the end is away from the oil reservoir 2.

The smoking end 5 of the electronic cigarette includes a smoking portion 52 that is projecting from the connection portion 51 in a direction away from the bracket 1 and bending towards one side. A blocking element configured to separate a battery 42 of the battery assembly 4 from the atomizer cavity 33 is also arranged in the bracket 1. The electronic cigarette further includes a button 54 which is arranged on the smoking end 5 or the bracket 1 and is configured to receive operation instructions of a user. A control assembly 55 is further connected to the button 54 and is configured to generate a control signal based on the operation instructions of a user. The control assembly 55 is connected to the heating wire assembly 31, so that the heating wire assembly 31 may atomizer the tobacco tar based on the control signal.

In conclusion, by arranging the oil reservoir 2 and the atomizer assembly 3 in parallel, the total length of the electronic cigarette is reduced, and thus the electronic cigarette is convenient to carry. Besides, the structure of the electronic cigarette is ingenious, and has a high mechanical strength. Besides, the diameter of the electronic cigarette is larger, and the sucking and holding of the electronic cigarette is full of fun, thereby meeting the psychological requirements of a smoker who often smokes a cigarette with a large diameter, such as a cigar. Furthermore, since the smoking channel is arranged inside the electronic cigarette body 1 and outside the oil reservoir 2, in this way, the tobacco tar may be prevented from leaking into the smoking channel, and the problems that oil is leaking and the tobacco tar is sucked into the mouth may be solved as a result.

Although the present application is illustrated with the embodiments accompanying the drawings, the present application is not limited to the above-mentioned specific embodiments, and the above-mentioned embodiments are only for illustration, not for limitation. In the inspiration of the present application, those skilled in the art may make many modifications, without going beyond the purpose and the scope the claims intend to protect of the present application; all these belong to the protection of the present application.

What is claimed is:

1. An electronic cigarette, comprising an electronic cigarette body and an oil reservoir (2) configured for reserving tobacco tar, wherein the electronic cigarette body includes a smoking end, an atomizer assembly (3) configured for atomizing the tobacco tar, and a battery assembly (4) electrically connected to the atomizer assembly (3) and configured for supplying power to the atomizer assembly (3); the battery assembly (4) and the oil reservoir (2) are arranged in parallel; the atomizer assembly (3) includes a heating wire assembly (31) which is arranged outside one end of the oil reservoir (2), wherein the end of the oil reservoir (2) is adjacent to the smoking end;

a smoking channel is provided inside the electronic cigarette body, wherein the smoking channel is arranged outside the oil reservoir (2) and is configured for discharging the smoke atomized by the atomizer assembly (3) to the outside of the electronic cigarette body; and wherein the oil reservoir (2) is transparent and is arranged outside the electronic cigarette body.

2. The electronic cigarette according to claim 1, wherein the oil reservoir (2) is detachably arranged on the electronic cigarette body.

3. The electronic cigarette according to claim 1, wherein the electronic cigarette body further includes a bracket (1), the atomizer assembly (3) and the oil reservoir (2) are respectively detachably connected to the bracket (1); one end of the atomizer assembly (3) is contained in the bracket (1), and the other end of the atomizer assembly (3) extends into the oil reservoir (2).

4. The electronic cigarette according to claim 3, wherein the battery assembly (4) is contained in the bracket (1).

5. The electronic cigarette according to claim 3, wherein a mouth of the oil reservoir (2) is sealed with an annular sealing plug (21) having a through-hole (22); and a piercable thin film (23) configured for sealing the oil reservoir (2) is arranged inside the through-hole (22) of the annular sealing plug (21).

6. The electronic cigarette according to claim 5, wherein the atomizer assembly (3) further includes an oil guiding mechanism (32) configured for conveying tobacco tar inside the oil reservoir (2) to the heating wire assembly (31) for the atomization of the tobacco tar;

wherein one end of the oil guiding mechanism (32) passes through the through-hole (22) and is further inserted in the oil reservoir (2); the oil guiding mechanism (32) and the through-hole (22) is sealed with the annular sealing plug (21).

7. The electronic cigarette according to claim 6, wherein one end of the oil guiding mechanism (32) that is outside the oil reservoir (2) is hollow, in which way that an atomizer cavity (33) is formed, and the heating wire assembly (31) is contained in the atomizer cavity (33).

8. The electronic cigarette according to claim 3, wherein the smoking end (5) is positioned at one end of the bracket (1), the end is away from the oil reservoir (2), and an air outlet (53) is formed on the smoking end (5); an air inlet (11) is defined in the bracket (1), and the atomizer cavity (33) is communicated with the air inlet (11) and the air outlet (53) respectively, in which way that the smoking channel is formed.

9. The electronic cigarette according to claim 8, wherein a first electrode array (34) is arranged at one end of the atomizer assembly (3), the end is close to the smoking end (5), and the first electrode array (34) is electrically connected to the atomizer assembly (3) and the battery assembly (4) respectively; wherein the first electrode array (34) is hollow, and is communicated with the atomizer cavity (33) and the air outlet (53) respectively.

10. The electronic cigarette according to claim 9, wherein the battery assembly (4) is detachably arranged inside the bracket (1); a second electrode array (41) is arranged at one end of the battery assembly (4), the end is close to the smoking end (5), and the second electrode array (41) is electrically connected to the battery assembly (4); the first electrode array (34) and the second electrode array (41) are electrically connected to each other.

11. The electronic cigarette according to claim 10, wherein the smoking end (5) includes a smoking portion (52) that is projected from the connection portion (51) in a direction away from the bracket (1) and bent towards one side.

12. The electronic cigarette according to claim 11, wherein the electronic cigarette further includes a button (54) which is arranged on the smoking end (5) or the bracket (1) and is configured to receive operation instructions of a user;

a control assembly (55) is further connected to the button (54) and is configured to generate a control signal based on the operation instructions of a user; wherein the control assembly (55) is connected to the heating wire assembly (31), in which way that the heating wire assembly (31) atomizer the tobacco tar based on the control signal.

13. The electronic cigarette according to claim 9, wherein the battery assembly (4) is fixedly arranged inside the bracket (1); a third electrode array electrically connected to the first electrode array (34) is arranged on the bracket (1); wherein the atomizer assembly (3) is electrically connected to the battery assembly (4) via the first electrode array (34), the third electrode array and wires connected to the third electrode array.

14. The electronic cigarette according to claim 13, wherein a charging assembly (14) configured for supplying power to the battery assembly (4) is provided on the bracket (1).

15. The electronic cigarette according to claim 8, wherein a blocking portion (56) configured for preventing the tobacco tar condensed from being sucked in is extending from an edge of the air outlet (53) in a direction opposite to a flowing direction of the airflow.

16. The electronic cigarette according to claim 15, wherein the smoking end (5) includes a connection portion (51) which is detachably mounted on the bracket (1).

17. The electronic cigarette according to claim 16, wherein the smoking end (5) includes a smoking portion (52) in shape of a frustum with its diameter reduced from the connection portion (51) along a direction away from the bracket (1) by a constant-gradient method.

18. An electronic cigarette, comprising an electronic cigarette body and an oil reservoir configured for reserving tobacco tar, wherein the electronic cigarette body includes a smoking end, an atomizer assembly (3) configured for atomizing the tobacco tar, and a battery assembly (4) electrically connected to the atomizer assembly (3) and configured for supplying power to the atomizer assembly (3); the battery assembly (4) and the oil reservoir (2) are arranged in parallel; the atomizer assembly (3) includes a heating wire assembly (31) which is arranged outside one end of the oil reservoir (2), wherein the end of the oil reservoir (2) is adjacent to the smoking end; a smoking channel is provided inside the electronic cigarette body, wherein the smoking channel is arranged outside the oil reservoir (2) and is configured for discharging the smoke atomized by the atomizer assembly (3) to the outside of the electronic cigarette body; the oil reservoir (2) is transparent and is arranged outside the electronic cigarette body;

the atomizer assembly (3) further includes an oil guiding mechanism (32) configured for conveying tobacco tar inside the oil reservoir (2) to the heating wire assembly (31) for the atomization of the tobacco tar;

a mouth of the oil reservoir (2) is sealed with an annular sealing plug (21) having a through-hole (22); one end of the oil guiding mechanism (32) passes through the through-hole (22) and is further inserted in the oil reservoir (2); one end of the oil guiding mechanism (32) is hollow in which way that an atomizer cavity (33) is formed, wherein the end is outside the oil reservoir (2), and the heating wire assembly (31) is contained in the atomizer cavity (33); the smoking end (5) is positioned at one end of the bracket (1), wherein the end is away from the oil reservoir (2), and an air outlet (53) is formed on the smoking end (5); an air inlet (11) is defined in the bracket (1), and the atomizer cavity (33) is communicated with the air inlet (11) and the air outlet (53) respectively, in which way that the smoking channel is formed.

19. An assembly method for an electronic cigarette, wherein the assembly method is configured for assembling an electronic cigarette, and comprising the following steps:

S1, providing a bracket (1) having a first electrode array (34) and a second electrode array (41), and electrically connecting the first electrode array (34) to the second electrode array (41); providing an oil reservoir in which an atomizer assembly (3) is partially inserted; defining a through-hole (22) configured to hold the atomizer assembly (3) inserted in the oil reservoir (2), and arranging an annular sealing plug (21) sealed with a thin film (23) on the through-hole; electrically connecting the first electrode array (34) to a second electrode array (41) through a bouncing pin electrode;

S2, one end of an oil guiding mechanism (32) of the atomizer assembly (3) piercing the thin film (23) and further inserting into the oil reservoir (2); sealing the through-hole (22) and the oil guiding mechanism (32) with the annular sealing plug (21); fixedly connecting the other end of the oil guiding mechanism (32) to the first electrode array (34);

S3, forming an atomizer cavity (33) at one end of the oil guiding mechanism (32), the end of the oil guiding mechanism (32) being away from the oil reservoir (2), and arranging a heating wire assembly (31) in the atomizer cavity (33); electrically connecting the heating wire assembly (31) to the battery assembly (4);

S4, containing the battery assembly (4) in the bracket (1), and arranging the atomizer assembly (3) and the battery assembly (4) in parallel; electrically connecting the battery assembly (4) to a second electrode array (41); arranging the smoking end (5) at one end of the bracket (1), the end being away from the oil reservoir (2).

* * * * *